US005468043A

United States Patent [19]

Chien

[11] Patent Number: 5,468,043

[45] Date of Patent: Nov. 21, 1995

[54] FOLDABLE CHAIR

[75] Inventor: Jui-Lung Chien, Taichung City, Taiwan

[73] Assignee: Jina Manufacturer Thai Co., Ltd., Bangkok, THX

[21] Appl. No.: 291,102

[22] Filed: Aug. 16, 1994

[51] Int. Cl.[6] ..... A47B 83/02

[52] U.S. Cl. ..... 297/153; 297/135; 297/31

[58] Field of Search ..... 297/31–33, 16.1, 297/135, 148, 153, 440.1, 447, 449, DIG. 11, 325–328, 29, 46, 47, 55, 174, 313, 331, 335, 337, 445, 446, 448, 250.1

[56] References Cited

U.S. PATENT DOCUMENTS

| | | | |
|---|---|---|---|
| 162,447 | 4/1875 | Wilson | 297/31 X |
| 179,242 | 7/1876 | Wetherbee | 297/31 |
| 240,498 | 4/1881 | Bartell | 297/31 |
| 841,022 | 1/1907 | Lahm | 297/32 X |
| 1,342,650 | 6/1920 | Schlegel | 297/31 |
| 1,876,479 | 9/1932 | Weller | 297/55 X |
| 2,203,610 | 6/1940 | Bascom et al. | 297/328 X |
| 3,132,895 | 5/1964 | Pollington | 297/153 X |
| 4,718,717 | 1/1988 | Cruz | 297/153 X |
| 4,795,209 | 1/1989 | Quinlan, Jr. et al. | 297/153 |
| 5,207,478 | 5/1993 | Freese et al. | 297/16.1 X |

FOREIGN PATENT DOCUMENTS

| | | | |
|---|---|---|---|
| 1448853 | 7/1966 | France | 297/148 |

*Primary Examiner*—Milton Nelson, Jr.

*Attorney, Agent, or Firm*—Merchant, Gould, Smith, Edell, Welter & Schmidt

[57] ABSTRACT

A foldable chair includes a seat, a back, two front legs and two rear legs. The seat is pivotally engaged to the front legs and the two rear legs are engaged to the seat such that the seat and the rear legs connected thereto can be rotated according to a pivotal feature thereof. A U-shaped frame is pivotally engaged to a grounded end of each front leg and the rear legs are engaged to the U-shaped frame. A dining board is separably engaged to both sides of the back.

4 Claims, 3 Drawing Sheets

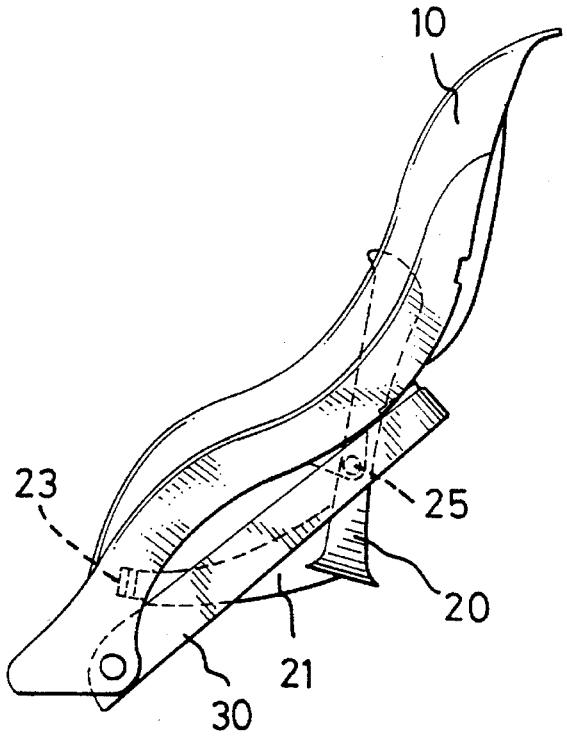
FIG.3
FIG.4
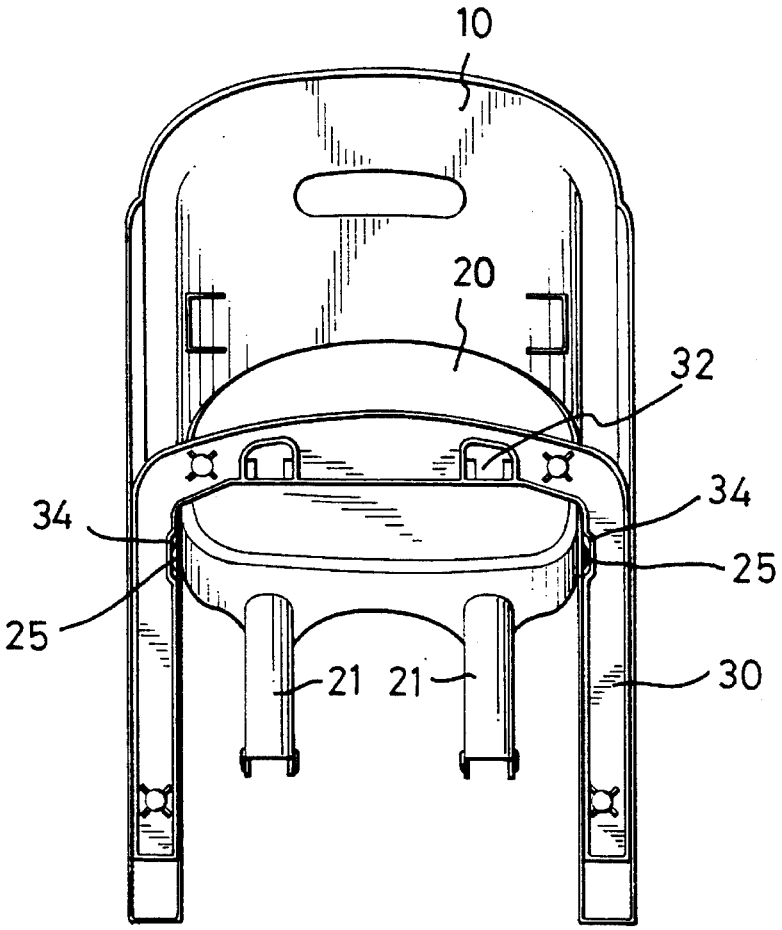

FOLDABLE CHAIR

BACKGROUND OF THE INVENTION

The present invention relates to a foldable chair and more particularly, to a chair which has a separable dining board and a foldable body.

There are many kinds of chairs which have a rigid body having a seat, a back, two arms and four legs. In some circumstances, the chairs are required to be foldable for saving space. In particular, a chair designed for use by a child having a surface for supporting a meal usually cannot be folded, and such chairs will occupy too much space, a concern for some locales such as a kindergarten.

The present invention intends to provide a foldable chair which has a separable dining board and a foldable body to mitigate and/or obviate the above-mentioned problems.

SUMMARY OF THE INVENTION

The present invention provides a foldable chair which includes a seat, a back, two front legs and two rear legs. The seat is pivotally engaged to the front legs and the two rear legs are engaged to the seat such that the seat and the rear legs connected thereto can be rotated according to a pivotal feature thereof and this reduces the space occupied thereby. A dining board is separably engaged to both front legs.

It is an object of the present invention to provide a foldable chair which includes a back and two front legs formed as one piece and a seat and two rear legs formed as one piece such that the seat and the rear legs can be rotated to reduce the space occupied thereby.

Other objects, advantages, and novel features of the invention will become more apparent from the following detailed description when taken in conjunction with the accompanying drawings.

BRIEF DESCRIPTION OF THE DRAWINGS

FIG. 3 is a side elevational view of the foldable chair showing that a seat and rear legs in accordance with the present invention are rotated to a position shown by phantom lines;

FIG. 4 is a rear elevational view of the folded chair shown in FIG. 3

DETAILED DESCRIPTION OF THE PREFERRED EMBODIMENT

Figure 1:
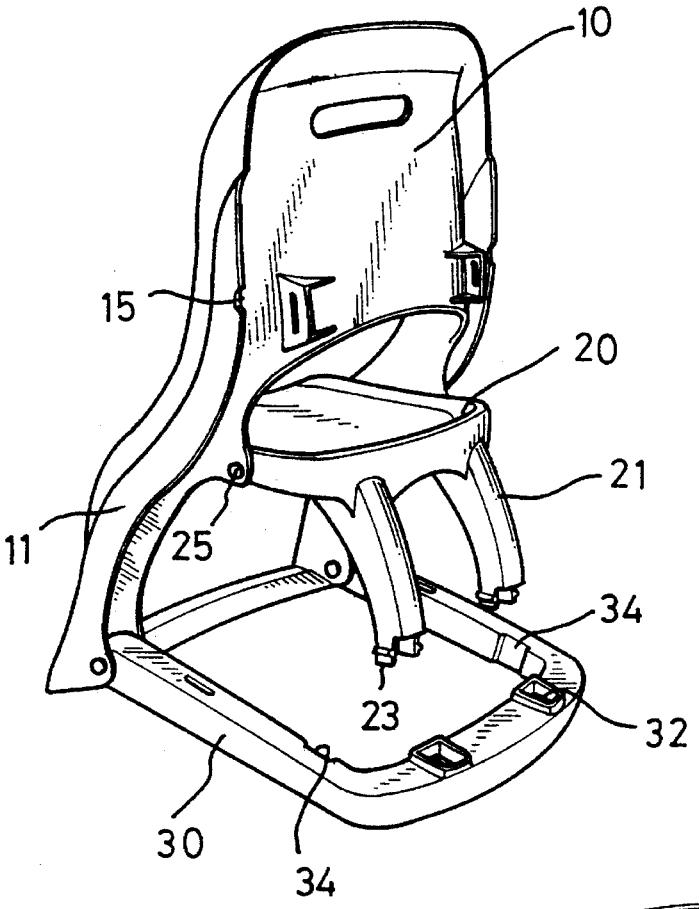
FIG. 1 is a perspective view, from rear end, of a foldable chair in accordance with the present invention.
Figure 2:
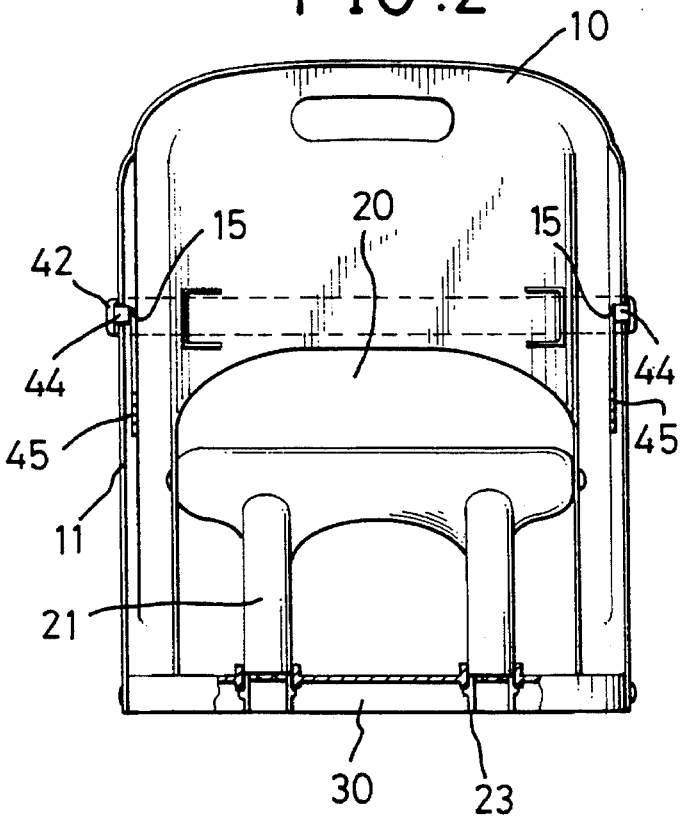
FIG. 2 is a rear end elevational view of the foldable chair in accordance with the present invention.

Referring to the drawings and initially to FIGS. 1 and 2, a foldable chair in accordance with the present invention generally includes a back 10, a seat 20, two front legs 11 and two rear legs 21. The back 10 and the front legs 11 are formed as one piece, namely, the back 10 is defined by an enclosure of an extension of each front leg 11, and the front leg 11 has a grounded end. Each of the rear legs 21 has first and second ends, the first end thereof is connected to an under side of the seat 20 and the second end thereof has two hook elements 23 extending downward therefrom. The seat 20 is pivotally engaged to a rear side of each front leg 11 by a pin 25 whose head extends transversely from an outer side of the front leg 11.

A U-shaped frame 30 is pivotally engaged to the grounded ends of the front legs 11, two receiving recesses 32 are defined in the U-shaped frame 30 for engagement to the hook elements 23 of the two rear legs 21. A recess 34 is defined in opposite inner sides of the U-shaped frame 30.

Referring now to FIGS. 3 and 4, the chair can be folded first by disengaging the hook elements 23 of the rear legs 21 from the receiving recesses 32 of the U-shaped frame 30 and then rotating the seat 20 about the pins 25, and second by lifting the U-shaped frame 30 about pivotal portions with the grounded ends of the front legs 11 such that the seat 20 and the U-shaped frame 30 are rotated and positioned close to the back 10 between the front legs 11 by which the chair occupies less space, and the head of the pin 25 is received in the recess 34 to set the position of the U-shaped frame 30.

Figure 5:
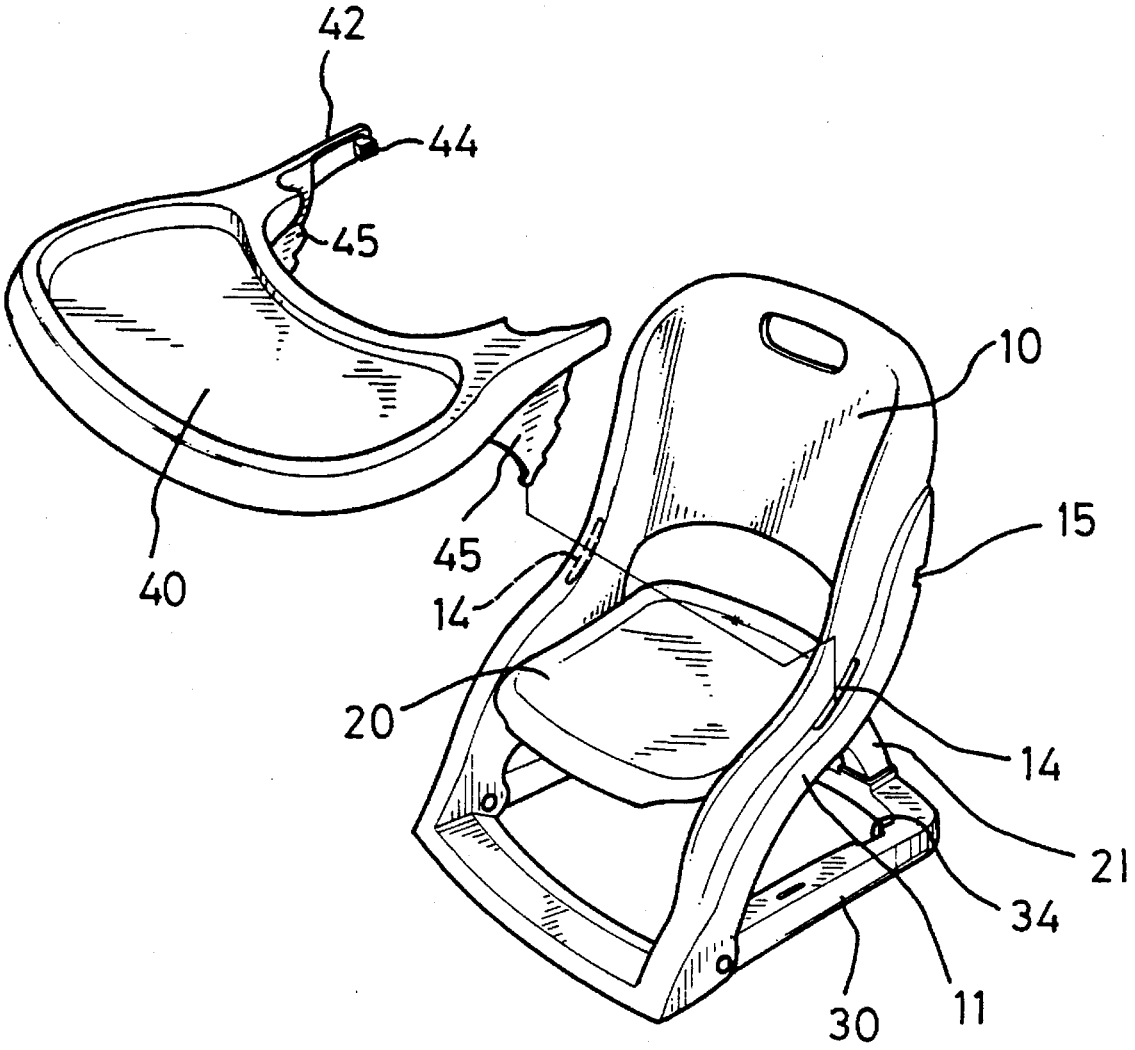
FIG. 5 is an exploded view of the foldable chair in which shows a separable dining board.

Referring to FIG. 5, a separable dining board 40 can be engaged to the foldable chair. The dining board 40 has two side arms 42 extending horizontally therefrom, a catch 44 disposed at a distal end of each side arm 42 and extending transversely therefrom and a plate 45 extends downwardly from an under side of each side arm 42. A slot 14 is defined in each of the front legs 11 for receiving the plate 45 of the dining board 40 and a recess 15 is defined in a rear side of the back 10 for engaging to the catch 44 of the side arm 42 such that the dining board 40 is separably engaged to the chair.

Although the invention has been explained in relation to its preferred embodiment, it is to be understood that many other possible modifications and variations can be made without departing from the spirit and scope of the invention as hereinafter claimed.

I claim:

1. A foldable chair comprising a seat, a back, two front legs and two rear legs, said rear legs being connected to said seat, said seat being disposed between said front legs and pivotally engaged to an inner side of each of said front legs, each of said front legs having a slot defined therein, a dining board having two side arms extending horizontally therefrom, each said side arm having a catch extending transversely from a distal end thereof engageable with said back, each said side arm having a plate extending downwardly from an underside thereof insertable into said slot.

2. The foldable chair as claimed in claim 1 wherein said back has a recess defined in each side thereof for receiving said catch of said side arm of said dining board.

3. The foldable chair as claimed in claim 1 further comprising a U-shaped frame having two receiving recesses formed therein; each of said front legs having a grounded end; the U-shaped frame being pivotally engaged to the grounded ends of the front legs, and the receiving recesses receiving the rear legs.

4. The foldable chair as claimed in claim 1 wherein said back comprises an enclosure defined by an extension of said two front legs.

* * * * *

UNITED STATES PATENT AND TRADEMARK OFFICE
CERTIFICATE OF CORRECTION

PATENT NO. : 5,468,043

DATED : November 21, 1995

INVENTOR(S) : Chien

It is certified that error appears in the above-identified patent and that said Letters Patent is hereby corrected as shown below:

Title page, item,
[73], Assignee: "THX" should read --Thailand--

Signed and Sealed this

Seventeenth Day of December, 1996

*Attest:*

Bruce Lehman

BRUCE LEHMAN

*Attesting Officer*

*Commissioner of Patents and Trademarks*